United States Patent [19]

Agius

[11] 4,373,414

[45] Feb. 15, 1983

[54] CODED KEY CUTTING DEVICE

[76] Inventor: Frank P. Agius, 909 Washington Ave., Alpena, Mich. 49707

[21] Appl. No.: 194,255

[22] Filed: Oct. 6, 1980

[51] Int. Cl.[3] ..... B26F 1/12

[52] U.S. Cl. ..... 83/414; 83/917; 269/56; 269/66; 414/16

[58] Field of Search ..... 408/91; 83/917, 413, 83/414; 269/56, 66; 33/174 TA, 1 M; 414/16, 750

[56] References Cited

U.S. PATENT DOCUMENTS

| | | | |
|---|---|---|---|
| 2,731,087 | 1/1956 | Cole | 83/917 X |
| 2,791,136 | 5/1957 | Smith | 408/91 |
| 2,812,816 | 11/1957 | Hoffman | 83/917 X |
| 3,496,636 | 2/1970 | Lieptz | 83/917 X |
| 3,722,341 | 3/1973 | Hungerford, Jr. | 83/413 |
| 3,884,121 | 5/1975 | Agius | 83/917 X |
| 3,981,214 | 9/1976 | Wich | 414/16 X |

*Primary Examiner*—James M. Meister

*Attorney, Agent, or Firm*—Harpman & Harpman

[57] ABSTRACT

A coded key cutting device for cutting key blanks using the manufacturer's code is comprised of a pair of movable carriage assemblies that index a key blank secured to one of the carriage assemblies under a punch cutter. Each of the assemblies is movably indexed according to an interchangeable cam depending on the manufacturer's code. The key blank is positioned for longitudinal and transverse movement under the punch so that a series of spaced notches can be made in the key blank.

6 Claims, 6 Drawing Figures

CODED KEY CUTTING DEVICE

BACKGROUND OF THE INVENTION (1) Field of the Invention

This invention relates to key cutters that use a manufacturer's code to cut key blanks using an indexing system to position the key blanks under a punch or similar cutter.

(2) Description of the Prior Art

Prior art devices have used a number of different indexing and positioning means that rely on spaced apertures and moving arms. See for example U.S. Pat. Nos. 3,981,214, 3,719,115.

Other key cutters use a threaded indexing device. See for example U.S. Pat. Nos. 3,769,865 and 2,812,816.

Applicant's device uses a pair of interchangeable cams that move the indexing carriages which are spring loaded into position under the punch, one of the indexing carriages carries the key blank.

SUMMARY OF THE INVENTION

The disclosed invention is a coded key cutting device for cutting a series of longitudinally spaced notches in a key blank corresponding to a key manufacturer's code. The device is comprised of a pair of movable carriage assemblies that move and index a key blank secured thereto both longitudinally and transversely under a cutter that punches the required notches in the key blank. The movable carriage assemblies are indexed by a pair of interchangeable cams corresponding to the manufacturer's code for the particular key shape desired. The key blank is held on one of the movable carriage assemblies by a clamp and positioning guide to properly align the key blank with the movable carriage.

DESCRIPTION OF THE PREFERRED EMBODIMENT

Figure 1:
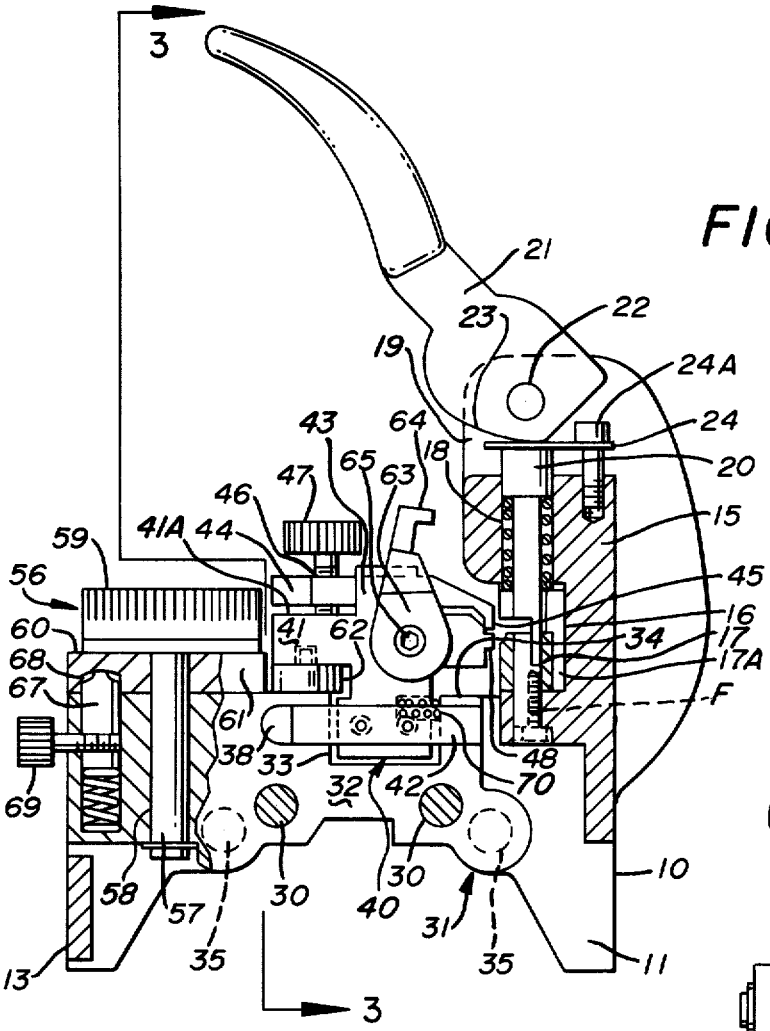
FIG. 1 is a side elevation of the key cutter with parts broken away and parts in cross section.
Figure 2:
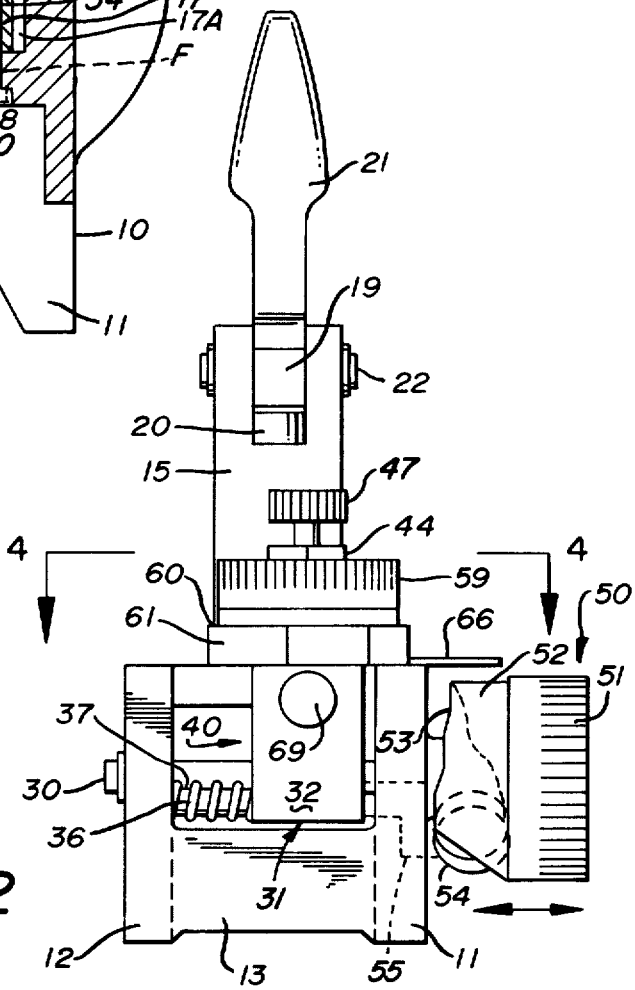
FIG. 2 is a front plan view thereof.

A coded key cutting device used to cut keys according to a manufacturer's code is seen in FIGS. 1 and 2 of the drawings comprising a main frame 10 having vertically extending legs 11 and 12 with oppositely disposed end connection members 13 and 14 therebetween. A punch support frame 15 extends vertically from one end of the frame 10 adjacent the connecting member 14 with the front portion of the punch support frame 15 recessed as indicated at 16. A die block 17 and a die block guide 17A are positioned within the recessed area 16 of the support frame 15, a portion of which overhangs the die block 17 and has a vertical bore 18 extending therethrough and in communication with a vertical slot 19 in the upper end of the punch support frame 15.

The die block 17 is held in position on the frame 10 in the recessed area 16 by a pair of fasteners F as seen in FIG. 1 of the drawings. A key punch 20 is movably positioned in the vertical bore 18, a handle 21 is pivotally positioned within the slot 19 by a pin 22. The handle 21 has a cam 23 on its lower end arranged to engage the upper end of the punch 20 so as to force the punch 20 downwardly within the vertical bore 18 against a spring. A leaf spring 24 is positioned between the cam 23 and the punch 20 by a screw 24A engaging the frame 15 and normally urges the handle 21 upwardly.

Figure 5:
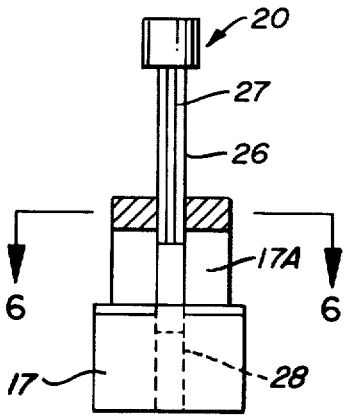
FIG. 5 is a front view of a die and punch of the key cutter.
Figure 6:
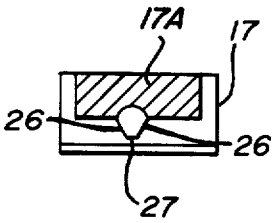
FIG. 6 is a cross section on line 6—6 of FIG. 5.
Figure 4:
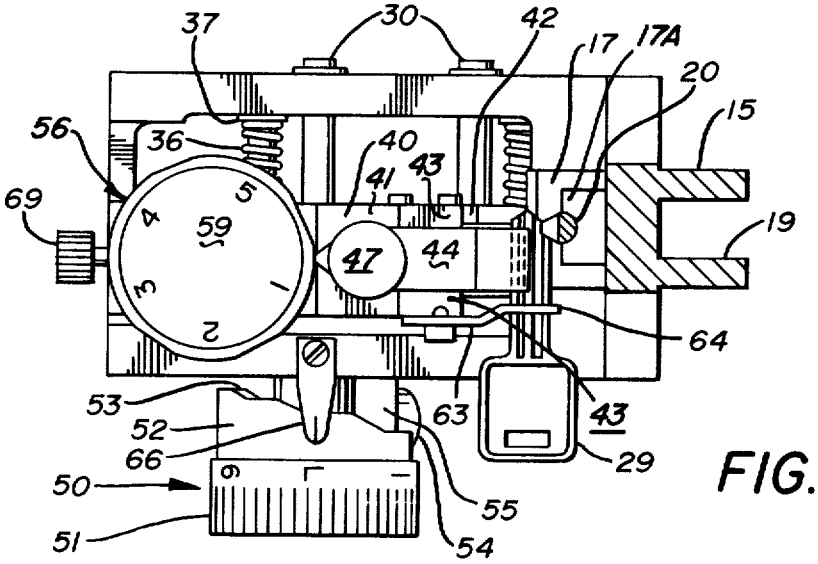
FIG. 4 is a top plan view on line 4—4 of FIG. 2 with a key blank positioned therein.

Referring now to FIGS. 5 and 6 of the drawings, the punch 20 and the die block 17 can be seen and wherein the punch 20 has flat outwardly angled sides 26 terminating in a blunt edge 27. The die block 17 has an opening 28 that precisely matches as seen in FIG. 4 the punch's configuration. The punch 20 makes a V-shaped flat bottom notch in one edge of a key blank 29.

Figure 3:
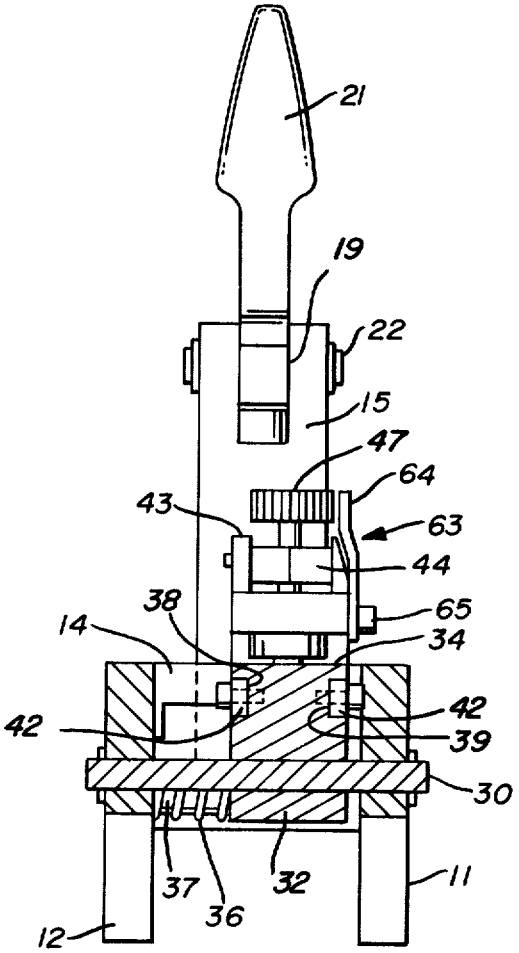
FIG. 3 is a cross sectional view on line 3—3 of FIG. 1.

Referring now to FIGS. 1,2 and 3 of the drawings, a pair of support guide shafts 30 will be seen to extend between the legs 11 and 12 with the ends of the shafts 30 engaged in apertures in the legs. A transversely movable carriage assembly 31 is engaged on the guide shafts 30 and is comprised of a main body member 32 having a recessed area 33 in its upper surface 34 adjacent the die block 17 on the main frame 10. A pair of spaced transversely extending bores 35 are formed in the main body member 32 and extend inwardly from one side thereof and act as receptacles for springs 36 and pins 37, the pins 37 being located within the convolution of the springs 36. A pair of longitudinally extending slots 38 and 39 are formed in the opposite sides of the body member 32 inwardly from the die block 17. There is a secondary movable carriage assembly 40, which comprises a secondary body member 41 having a depending portion movably positioned in the recessed area 33 of the main body member 32. Guide bars 42 are slidably engaged in the slots 38 and 39 and are attached to the opposite sides of the depending portion of the secondary body member 41. The secondary body member 41 has a pair of transversely spaced upwardly extending arms 43 thereon and a clamp arm 44 is pivotally mounted therebetween. The clamp arm 44 has a downwardly extending flange 45 at one end and a threaded aperture 46 inwardly of the other end. A thumb screw 47 is engaged in the aperture 46 and abuts the upper surface 41A of the secondary body member 41. The flange 45 is positioned over a stationary jaw 48 that extends outwardly from the secondary body member 41 adjacent the die block 17. The jaw 48 is engaged by the flange 45 when the clamp arm 44 is moved downwardly by the thumb screw 47 so as to hold the key blank 29 positioned thereon as seen in FIG. 4 of the drawings.

By referring now to FIGS. 2 and 4 of the drawings, the movable carriage assembly 31 is shown moved sidewardly on the guide shafts 30 by a cam assembly 50 which is rotatably secured on a projecting end of one of the guide shafts 30. The cam assembly 50 comprises a knob 51 having an annular flange 52 extending therefrom, the edge of which is a cam surface 53 having flat indexing areas thereon. A cam follower 54 is rotatably mounted on a sidewardly extending arm 55 on the body member 32 so as to impart transverse movement to the body member 32 of the movable carriage assembly 31 when the cam assembly 50 is rotated.

The spring and pin assemblies 36 and 37 provide lateral resistance to the movement of the body member 32 thereby maintaining the proper cam and follower engagement.

The secondary movable carriage assembly 40 is moved axially toward and away from the die block 17 by a secondary cam assembly 56 secured to a shaft 57 positioned in a bore 58 the body member 32.

The secondary cam assembly 56 has a secondary knob 59 with an annular flange 60, the peripheral edge of which is a cam surface 61 having flat indexing areas thereon. A secondary cam follower 62 is rotatably secured to the body member 41 for moving the body member 41. Referring now to FIGS. 1 and 4 of the drawings, a key guide arm 63 can be seen secured to the side of the body member 41. The key guide arm 63 has an offset hook 64 at one end and is pivoted on a screw 65 positioned through an opening in the other end thereof so as to engage the opposite side of the key blank 29, thus positioning the key blank 29 properly between the clamp arm 44 and the stationary jaw 48.

In operation the key blank 29 is positioned in the device as hereinbefore described and a first punch portion longitudinally of the key blank 29 is determined by rotating the knob 51 so that indicia thereon relating to the manufacturer's code is aligned with an indicator 66, thus moving the body members 32 and 41 and the key blank 29 transversely of the device. The secondary knob 59 is then rotated so that indicia thereon relating to the manufacturer's code for depth of cut is aligned with the pointed end of the clamp arm 44 moving the cam surface 61 against the cam follower 62 thereby moving the secondary carriage assembly 40 and the key blank 29 clamped thereto forwardly and under the punch 20.

A spring 70 partially engaged in the depending portion of the body member 41 engages the main body member 32 insuring the spring urged engagement of the cam follower 62 against the cam surface 61. The handle 21 is moved downwardly engaging the punch 20 which in turn notches the key blank 29 positioned therebeneath. This procedure is repeated following the manufacturer's code for the key required. When a different manufacturer's code is required, the knobs and cam assemblies can be removed and different cams substituted having different cam paths conforming to the code requirements.

So that the secondary cam assembly 56 can be locked in a desirable depth of cut position, a spring loaded movable lock pin 67 is mounted within the body member 32 adjacent one end thereof for registering engagement with anyone of a number of circumferentially spaced indentations 68 in the underside of the secondary cam assembly 56. (See FIG. 1).

The lock pin 67 has a thumb screw 69 therethrough to hold the lock pin 67 in the desired position. This allows the operator to lock the secondary cam assembly 56 in one setting to make several successive uniform notches in the key blank 29.

Thus it will be seen that a new and useful coded key cutting device has been illustrated and described and it will be apparent to those skilled in the art that various changes and modifications may be made therein with departing from the spirit of the invention and having thus described my invention.

What I claim is:

1. An improvement in a coded key cutting device, said device having a frame, means at one end of the frame defining a cutting area, first and second carriage assemblies movable relative to one another and to said frame, said first carriage assembly arranged for transverse movement on said frame and said second carriage assembly positioned on said first carriage assembly and arranged for movement axially thereof, said improvement comprising a first cam assembly on said frame arranged to impart movement on said first carriage assembly, said first cam assembly comprising a knob rotatably mounted on said frame, an annular flange on said knob, a cam configuration on said annular flange and a cam follower on said first carriage assembly engaging said cam, a secondary cam assembly on said first carriage assembly arranged to impart movement to said secondary carriage assembly, means for securing a key blank to said second carriage assembly, a die and a punch located within said cutting area, said punch being reciprocal relative to said die, means for indexing said cam assemblies and means for moving said punch.

2. The improvement in a coded key cutting device as set forth in claim 1 and wherein said secondary cam assembly comprises a knob rotatably mounted on said first carriage assembly, a circular cam body on said knob, a cam follower on said secondary carriage assembly engaging said circular cam body.

3. An improvement in a coded key cutting device, said device having a frame, means at one end of the frame defining a cutting area, first and second carriage assemblies movable relative to one another and to said frame, said first carriage assembly arranged for transverse movement on said frame and said second carriage assembly positioned on said first carriage assembly and arranged for movement axially thereof, said improvement comprising a first cam assembly on said frame arranged to impart movement to said first carriage assembly, a secondary cam assembly on said first carriage assembly arranged to impart movement to said secondary carriage assembly, said secondary cam assembly comprising a knob rotatably mounted on said first carriage assembly, a circular cam body on said knob, a cam follower on said secondary carriage assembly engaging said circular cam body, means for securing a key blank to said second carriage assembly, a die and a punch located within said cutting area, said punch being reciprocal relative to said die, means for indexing said cam assemblies, and means for moving said punch.

4. The key cutting device of claims 1, 3 or 2 and wherein said means for positioning said carriage assemblies comprises guide shafts on said frame engaged in bores in said first carriage assembly and guide bars on said second carriage assembly slidably engaged in grooves in the opposite sides of said first carriage assembly.

5. The key cutting device of claims 1, 3 or 2 and wherein a clamp arm is pivoted to said second carriage assembly and arranged to engage said key blank so as to hold the same on said die block and means for moving said clamp arm.

6. The key cutting device of claims 1, 3 or 2 wherein said cutting area is defined by a punch support frame on one end of said first mentioned frame, said punch being reciprocally mounted in a bore in said punch support frame, a handle and means pivoting the handle to said support frame above said bore and a cam on said handle engagable with said punch.

* * * * *